US006830821B2

(12) United States Patent
Bibber

(10) Patent No.: US 6,830,821 B2
(45) Date of Patent: Dec. 14, 2004

(54) PASSIVATING OF TIN, ZINC AND STEEL SURFACES

(75) Inventor: John W. Bibber, Batavia, IL (US)

(73) Assignee: Sanchem, Inc., Chicago, IL (US)

( * ) Notice: Subject to any disclaimer, the term of this patent is extended or adjusted under 35 U.S.C. 154(b) by 57 days.

(21) Appl. No.: 10/307,857

(22) Filed: Dec. 2, 2002

(65) Prior Publication Data

US 2004/0104122 A1 Jun. 3, 2004

(51) Int. Cl.[7] ..... C04B 9/02; C22C 22/00; B32B 15/04

(52) U.S. Cl. ..... 428/457; 148/248; 148/274; 106/14.42; 106/14.22; 106/14.24; 205/198; 205/317; 428/458

(58) Field of Search ..... 428/457, 459; 106/14.41, 14.42, 14.15, 14.22, 14.23, 14.24, 14.25; 205/316, 317, 138, 140, 141, 198; 148/248, 274

(56) References Cited

FOREIGN PATENT DOCUMENTS

JP 50-091546 A * 7/1975

* cited by examiner

*Primary Examiner*—Paul Thibodeau
*Assistant Examiner*—Kevin R. Kruer
(74) *Attorney, Agent, or Firm*—James B. Conte; Barnes & Thornburg LLP

(57) ABSTRACT

A method for coating zinc, zinc plated, or steel articles with a hydroxy benzoic acid protective coating by coating a cleaned zinc, zinc plated, or steel with a hydoxy benzoic acid composition having a pH of about 2.0 to 5.0; and coating cleaned tin surfaced articles with a composition having a PH of 2.0 to 12.0, and the composition having as its essential ingredients proteins, amino acids, amino acid—protein compounds and amine alcohols; and the articles produced thereby along with the coated articles having an appropriate paint thereon.

2 Claims, No Drawings

PASSIVATING OF TIN, ZINC AND STEEL SURFACES

FIELD OF INVENTION

This invention relates to coating tin, zinc or steel surfaces with a protective coating that permits acceptable paint adhesion to the surfaces so coated and to the coated tin, zinc and steel articles. More particularly, the present invention provides a protective tin coating by electrolytically coating the tin with a composition having as its essential ingredients amino acids, proteins, amino acids-protein, amino alcohols and mixtures thereof; or inorganic acids and a method of coating the tin surface of the articles and the tin articles so coated; and the coated tin articles which are painted. My invention also provides for a zinc, or plated zinc, or steel coated with a protective coating having a coating composition containing hydroxy benzoic acids; the articles so coated; and the articles coated and painted.

BACKGROUND OF THE INVENTION

Unpassified zinc will quickly form a thin film of zinc oxide which will prevent the adhesion of paint. Passification will prevent the growth of zinc oxides (see British patent No. 592,072; Wendorff, Z., Zolnierowicz, A.; Ochronaprzad Korozja, 13, 1 (1970); Ostrander, G. W.: Plating, 38 1033 (1951); and British Patent No. 594,699). Typical passification processes use a dichromate or a chromate composition. The compositions are applied by via simple immersion or by electrochemical methods (see Fishlock, D. J.: Product Finishing, 12, 87 (1959). A number of different PH's, immersion times and temperatures may be used. The use of a chromate or dichromate passification method will generally increase the salt-spray ("ASTM-B117" testing specification) corrosion resistance of a zinc passified surface by a factor of ten to thirty depending upon the method of passification used (see: Stareck, J. E., Cybulskis, W. S.: Proc. Am. lectroplaters Soc. 34, 235 (1947). As such chromate, or dichromate, compositions are generally considered to produce the most corrosion resistant of films. The hexavalent chromium present in the chromate and/or dichromate compositions is extremely toxic and as such is being banned from use in Europe and many areas of the United States.

The thin natural oxide film on tin surfaces provides a protective barrier and improves paint adhesion. Maintaining this oxide film while preventing a rapid uncontrolled growth to a thick yellow non-protective and non-adhesive layer has always been the goal of tin plate producers. In addition, foods high in sulfur will stain tin surfaces not properly passified.

Previous attempts at passification of tin have centered around the thickening of the natural oxide film with an oxidant while leaving a corrosion resistant film on the surface of the metal to retard further oxide growth and prevent sulfide stains. In 1931 S. R. Mason (Mason, S. R., U.S. Pat. No. 1,827,204) patented an electrolytic process which used chromates to both thicken the oxide film and leave a film of reduced chromic oxides to prevent further oxide growth or the formation of sulfide stains. In 1935 a French patent (Tichauer, French Patent 777,314) detailed a process which used molybdates, an oxidant and various heavy metals to give a passive film on the surface of the metal. In the same year U.S. Pat. No. 2,024,951 described a process which used potassium permanganate to both stabilize the oxide film and reduce sulfide staining. In 1940 U.S. Pat. No. 2,215,165 described an electrolytic process which oxidized and then reduced the tin surface to thicken the oxide film and leave a passive tin surface. In 1943 W. O. Cook and H. E. Romine (U.S. Pat. No. 2,312,076) obtained patents on a process which used dichromates mixed with phosphates to passivate tin surfaces. Since that time all processes have centered around improvements in this basic chromate/dichromate process. Once again, chromate use is being restricted in Europe and the United States and in many cases has been banned from use.

The widely used method for increasing the paint adhesion of steel is to form a film of iron phosphate on the surface of the metal and then "seal" the phosphated surface with a chromate or dichromate composition (see: Mohler, J. B., Metal Finishing, 69,10,47 (1971) for increased corrosion resistance. Increased restrictions on the use of chromate compositions in the United States and Europe are making this process more and more difficult to use.

SUMMARY OF THE INVENTIONS

My inventions eliminates the need for hexavalent chromium compositions which, due to their extreme toxicity, are being removed from the work place environment. In addition my processes provides the same high level of corrosion resistance, paint adhesion and, in the case of tin, sulfide stain resistance. My processes are less expensive to produce and free of toxic chemicals which require expensive disposal methods for their removal.

I. Tin Surfaces:

I provide a protective coating for tin surfaces such as tin and tin coated steel. The protective coating has as its essential ingredients proteins, amino acids or amino acid—protein compounds and amine alcohols. The process uses electrolysis of various protein salts made by dissolving the proteins in an acid solution, or by dissolving the proteins with a base. The amino acids, amines, amine alcohols or inorganic compounds may be added to the mixture to complex with the proteins and enhance their paint adhesion or protective ability. The lower limit of the concentration of these solutions is purely an economic matter. The lower the concentration of the materials to be deposited, the longer it will take to produce a film of sufficient thickness (about 600 nm) to provide a good paint base and sufficient resistance to oxidation and sulfide staining. Coil coating lines for tin coated steel normally do not allow for more then five seconds of exposure at a current density of about 10 to 25 amps per square foot. This will normally require a concentration of at least 0.5%, depending upon the composition of the mixture in question. The upper limits on the concentration of the solution will be the saturation point of the mixture in question. In theory any PH may be used, but tin dissolves in strongly acid or basic solutions. The most suitable PH range is 2.0 to 12.0 with the preferred PH being 2.5 to 11.0. Temperature is of no concern to the process. The voltage must be above the reduction potential of the protein complexes and sufficient to maintain the required current density. Various other non-interfering materials may be added to the protein solutions to prevent biological attack, act as wetting agents, increase conductivity, improve paint adhesion or to control the PH (buffers) as long as these materials do not act to prevent proper film formation.

In the following Examples 1–11 a tin plated steel surface or a pure tin sheet was cleaned of oils and/or loose dirt with a non-ionic detergent and then made the anode of an electrolytic cell of 12 volts and a current density of about 10 amps per square foot for 30 seconds in a solution of 3.0 grams per liter sodium carbonate to obtain a clean and reactive surface. The surfaces were then rinsed in D. I. (deionized)

water and treated as indicated. The metal strips were 4 inches by 10 inches. Examples 4, 8 and 9 illustrate the outer limits of the specified PH range.

EXAMPLE 1

A solution of 10.0 grams per liter of casein in water was prepared by adding enough phosphoric acid to cause it to dissolve. The PH was then adjusted to 2.5 by the addition of more phosphoric acid. This solution was then used as an electrolytic cell in which a tin metal strip, or tin plated steel strip, was used as the anode and stainless steel was used as the cathode. Twelve volts and a current density of about 11 amps per square foot was applied to the solution for a period of five seconds. The tin, or tin plated steel, was then rinsed in D. I. water, dried and placed in a boiling solution of 6.67 g/liter sodium thiosulfate five hydrate, 1.67 g/liter sulfuric acid and 1.0 g/liter non-ionic wetting agent for two minutes. The exposed tin surface showed no sulfide staining. Baking the rest of the exposed tin surface at 420° F. for one hour showed no yellowing due to tin oxide formation.

EXAMPLE 2

A solution of 10.0 grams per liter of casein in water was prepared by adding enough glycolic acid to cause it to dissolve. The PH was then adjusted to 3.0 by the addition of more glycolic acid and heated to 180° F. to partially hydrolyze the casein and make the solution more stable towards the addition of inorganic salts. One gram of potassium nitrate was then added to the solution to increase conductivity and improve paint adhesion and it was cooled to 70° F. This solution was then used as an electrolytic cell in which a tin metal strip, or tin plated steel strip, was used as the anode and stainless steel was used as the cathode. Twelve volts and a current density of about 11 amps per square foot was applied to the solution for a period of five seconds. The tin, or tin plated steel, was then rinsed in D. I. water, dried and then coated with "Valspar, 625605GLDEPOXY", cured at 400° F. for ten minutes and subjected to the standard "ASTM 3359-87" dry paint adhesion test. There was no loss of adhesion.

EXAMPLE 3

A solution of 10.0 grams per liter of casein in water was prepared by adding enough 2-amino-2-methyl-1-propanol to cause it to dissolve. The PH was then adjusted to 9.0. This solution was then used as an electrolytic cell in which a tin metal strip, or tin plated steel strip, was used as the anode and stainless steel was used as the cathode. Twelve volts and a current density of about 11 amps per square foot was applied to the solution for a period of five seconds. The tin, or tin plated steel, was then rinsed in D. I. water, dried and placed in a boiling solution of 6.67 g/liter sodium thiosulfate five hydrate, 1.67 g/liter sulfuric acid and 1.0 g/liter non-ionic wetting agent for two minutes. The exposed tin surface showed no sulfide staining. Baking the rest of the exposed tin surface at 420 degrees F. for one hour showed no yellowing due to tin oxide formation.

EXAMPLE 4

A solution of 10.0 grams per liter of casein in water was prepared by adding enough potassium hydroxide to cause it to dissolve. The PH was then adjusted to 12.0 by the addition of more potassium hydroxide. This solution was then used as an electrolytic cell in which a tin metal strip, or tin plated steel strip was used as the anode and stainless steel was used as the cathode. Twelve volts and a current density of about 11 amps per square foot was applied to the solution for a period of five seconds. The tin, or tin plated steel, was then rinsed in D. I. water, dried and placed in a boiling solution of 6.67 g/liter sodium thiosulfate five hydrate, 1.67 g/liter sulfuric acid and 1.0 g/liter non-ionic wetting agent for two minutes. The exposed tin surface showed minor sulfide staining. Baking the rest of the exposed tin surface at 420° F. for one hour showed no yellowing due to tin oxide formation.

EXAMPLE 5

A solution of 10.0 grams per liter of casein in water was prepared by adding enough phosphoric acid to cause it to dissolve. The PH was then adjusted to 4.0 by the addition of glycine. This solution was then used as an electrolytic cell in which a tin plated steel strip was used as the anode and stainless steel was used as the cathode. Twelve volts and a current density of about 11 amps per square foot was applied to the solution for a period of five seconds. The tin plated steel was then rinsed in D. I. water, dried and placed in a boiling solution of 6.67 g/liter sodium thiosulfate five hydrate, 1.67 g/liter sulfuric acid and 1.0 g/liter non-ionic wetting agent for two minutes. The exposed tin surface showed no sulfide staining. Baking the rest of the exposed tin surface at 420° F. for one hour showed no yellowing due to tin oxide formation.

EXAMPLE 6

A solution of 10.0 grams per liter of dried egg white in water was prepared by adding enough phosphoric acid to cause it to dissolve. The PH was then adjusted to 3.0 by the addition of more phosphoric acid. This solution was then used as an electrolytic cell in which a tin plated steel strip was used as the anode and stainless steel was used as the cathode. Twelve volts and a current density of about 11 amps per square foot was applied to the solution for a period of five seconds. The tin plated steel was then rinsed in D. I. water, dried and then coated with a standard polyamide resin, allowed to cure for seven days and subjected to the standard "ASTM 3359-87" dry paint adhesion test. There was no loss of adhesion.

EXAMPLE 7

A solution of 10.0 grams per liter of gelatin in water was prepared. To this solution was added 1.0 grams per liter of potassium nitrate and enough potassium hydroxide to adjusted the PH of the solution to 9.0. The solution was then used as an electrolytic cell in which a tin plated steel strip was used as the anode and stainless steel was used as the cathode. Twelve volts and a current density of about 11 amps per square foot was applied to the solution for a period of five seconds. The tin plated steel was then rinsed in D. I. water, dried and then coated with a standard polyamide resin, allowed to cure for seven days and subjected to the standard "ASTM 3359-87" dry paint adhesion test. There was no loss of adhesion.

EXAMPLE 8

A solution of 10.0 grams per liter of casein in water was prepared by was prepared by adding enough potassium hydroxide to cause it to dissolve. To this was added 1.0 grams of potassium nitrate. This solution was then adjusted to a PH of 12.0 and used as an electrolytic cell in which a tin plated steel strip was used as the anode and stainless steel was used as the cathode. Twelve volts and a current density of about 11 amps per square foot was applied to the solution for a period of five seconds. The tin plated steel was then rinsed in D. I. water, dried and then coated with a standard polyamide resin, allowed to cure for seven days and subjected to the standard "ASTM 3359-87" dry paint adhesion test. There was minor loss of adhesion.

EXAMPLE 9

A solution of 10.0 grams per liter of casein in water was prepared by was prepared by adding enough phosphoric acid to cause it to dissolve. This solution was then adjusted to a PH of 2.0 by the addition of more phosphoric acid and used as an electrolytic cell in which a tin plated steel strip was used as the anode and stainless steel was used as the cathode. Twelve volts and a current density of about 11 amps per square foot was applied to the solution for a period of five seconds. The tin plated steel was then rinsed in D. I. water, dried and then coated with a standard polyamide resin, allowed to cure for seven days and subjected to the standard "ASTM 3359-87" dry paint adhesion test. There was minor loss of adhesion.

EXAMPLE 10

An amino acid solution of 10.0 grams per liter consisting of; d—Glutamic acid—2.2 grams, d—Hydroxyglutamic acid—3.3 grams, 1—Leucine—1.0 grams, d—Lysine—0.8 grams, 1—Proline—0.8 grams, 1—aspartic acid—0.4 grams, d—valine—0.8 grams, and 1—Tyrosine—0.7 grams was dissolved in one liter of water by adding phosphoric acid. The PH was then adjusted to 2.5 by the further addition of phosphoric acid. This solution was then used as an electrolytic cell in which a tin metal strip, or a tin plated steel strip, was used as the anode and stainless steel was used as the cathode. Twelve volts and a current density of about 11 amps per square foot was applied to the solution for a period of five seconds. The tin, or tin plated steel, was then rinsed in D. I. water, dried and placed in a boiling solution of 6.67 g/liter sodium thiosulfate five hydrate, 1.67 g/liter sulfuric acid and 1.0 grams per liter non-ionic wetting agent for two minutes. The exposed tin surface showed no sulfide staining. Baking the rest of the exposed tin surface at 420° F. for one hour showed no yellowing due to tin oxide formation.

EXAMPLE 11

An amino acid solution of 10.0 grams per liter consisting of; d—Glutamic acid—2.2 grams, d—Hydroxyglutamic acid—3.3 grams, 1—Leucine—1.0 grams, d—Lysine—0.8 grams, 1—Proline—0.8 grams, 1—aspartic acid—0.4 grams, d—valine—0.8 grams, and 1—Tyrosine—0.7 grams was dissolved in one liter of water by adding phosphoric acid. The PH was then adjusted to 2.5 by the further addition of phosphoric acid. This solution was then used as an electrolytic cell in which a tin metal strip, or a tin plated steel strip, was used as the anode and stainless steel was used as the cathode. Twelve volts and a current density of about 11 amps per square foot was applied to the solution for a period of five seconds. The tin, or tin plated steel, was then rinsed in D. I. water, dried and then coated with a standard polyamide resin, allowed to cure for seven days and subjected to the standard "ASTM 3359-87" dry paint adhesion test. There was no loss of adhesion.

II. Steel and Zinc Surfaces:

I also provide a protective coating for steel and zinc surfaces. The protective coating has as its essential ingredient a hydroxy benzoic acid such as resorcylic acid and preferably a hydroxy or trihydroxy benzoic acid; 2,4,6 trihydroxybenzoic acid; 3,4,5 trihydroxybenzoic acid; and 2,3,4 trihydroxybenzoic acid, used by themselves or in combination. The process is used with or without electrolysis. With electrolysis, the metal to be coated is the anode of the electrolytic cell in question. The lower limit on the concentration of these solutions is purely an economic matter. The lower the concentration of the materials to be deposited, the longer it will take to produce a coating of the proper thickness to provide for paint adhesion and/or corrosion resistance (generally about 600 nm). The coating consists of the iron plus the salt of the acids being used or in the case of zinc, the zinc plus the salt of the acid. Essential to the proper formation of the coating is a PH with a lower limit of 2 and an upper limit of about 5. Below PH of 2 the metal salts that would be formed on the surface of the article will remain in solution. Above a PH of 5, not enough metal ions will be produced to give a thick enough coating. The temperature of the solution will have no effect upon the formation of the coating. The upper limit on the concentration of the acids is the saturation point of the acid in question. Other materials such as wetting agents, buffers for PH control or biological control agents may be added as long as they do not prevent proper coating formation. Examples 12 and 13 illustrate the outer limits of the acceptable pH range.

In the following Examples 12–28 a steel surface, zinc plated steel surface or a pure zinc sheet was cleaned of oils and/or loose dirt with a non-ionic detergent and then made the cathode of an electrolytic cell of 12 volts and a current density of about 10 amps per square foot for 30 seconds in a solution of 3.0 grams per liter sodium carbonate to obtain a clean and reactive surface. The surfaces were then rinsed in DI. water and treated as indicated. The metal strips were 3 inches by 5 inches.

EXAMPLE 12

A solution of 0.5 grams per liter of 2,3,4 trihydroxybenzoic acid with a PH of about 3.5 was used as an electrolytic cell in which a steel plate was used as the anode and stainless steel was used as the cathode. Sodium sulfate, 0.5 grams, was also added to the solution to increase its conductivity. Twelve volts and a current density of about 11 amps per square foot was applied to the solution for a period of five seconds. The steel plate was then rinsed in D. I. water, dried and then coated with a standard polyamide resin, allowed to cure for seven days and subjected to the standard "ASTM 3359-87" dry paint adhesion test. There was no loss of adhesion.

EXAMPLE 13

A solution of 0.5 grams per liter of 2,3,4 trihydroxybenzoic acid with a PH of about 3.5 was used as an electrolytic cell in which a steel plate was used as the anode and stainless steel was used as the cathode. Sodium sulfate, 0.5 grams, was also added to the solution to increase its conductivity. Twelve volts and a current density of about 11 amps per square foot was applied to the solution for a period of five seconds. The steel plate was then rinsed in D. I. water, dried and then subjected to constant humidity at a temperature of 100° F. for 336 hours. The panel showed no signs of corrosion.

EXAMPLE 14

A solution of 2.0 grams per liter of 2,3,4 trihydroxybenzoic acid with a PH of 2.0 was used as an electrolytic cell in which a steel plate was used as the anode and stainless steel was used as the cathode. Sodium sulfate, 0.5 grams, was also added to the solution to increase its conductivity. Twelve volts and a current density of about 11 amps per square foot was applied to the solution for a period of five seconds. The steel plate was then rinsed in D. I. water, dried and then subjected to constant humidity at a temperature of 100° F. for 336 hours. The panel showed minor signs of corrosion.

EXAMPLE 15

A solution of 0.5 grams per liter of 2,3,4 trihydroxybenzoic acid was adjusted to a PH of 5.0 with potassium hydroxide and used as an electrolytic cell in which a steel plate was used as the anode and stainless steel was used as the cathode. Sodium sulfate, 0.5 grams, was also added to the solution to increase its conductivity. Twelve volts and a current density of about 11 amps per square foot was applied to the solution for a period of five seconds. The steel plate was then rinsed in D. I. water, dried and then subjected to constant humidity at a temperature of 100° F. for 336 hours. The panel showed minor signs of corrosion.

EXAMPLE 16

A solution of 0.5 grams per liter of 2,4,6 trihydroxybenzoic acid with a PH of about 3.5 was used as an electrolytic cell in which a steel plate was used as the anode and stainless steel was used as the cathode. Sodium sulfate, 0.5 grams, was also added to the solution to increase its conductivity. Twelve volts and a current density of about 11 amps per square foot was applied to the solution for a period of five seconds. The steel plate was then rinsed in D. I. water, dried and then subjected to constant humidity at a temperature of 100° F. for 336 hours. The panel showed no signs of corrosion.

EXAMPLE 17

A solution of 2.0 grams per liter of 2,4,6 trihydroxybenzoic acid with a PH of 2.0 was adjusted to a PH of 4.0 by the addition of potassium hydroxide and used as an electrolytic cell in which a steel plate was used as the anode and stainless steel was used as the cathode. Sodium sulfate, 0.5 grams, was also added to the solution to increase its conductivity. Twelve volts and a current density of about 11 amps per square foot was applied to the solution for a period of five seconds. The steel plate was then rinsed in D. I. water, dried and then subjected to constant humidity at a temperature of 100 degrees F. for 336 hours. The panel showed no signs of corrosion.

EXAMPLE 18

A solution of 0.5 grams per liter of resorcylic acid with a PH of about 3.5 was used as an electrolytic cell in which a steel plate was used as the anode and stainless steel was used as the cathode. Sodium sulfate, 0.5 grams, was also added to the solution to increase its conductivity. Twelve volts and a current density of about 11 amps per square foot was applied to the solution for a period of five seconds. The steel plate was then rinsed in D. I. water, dried and then subjected to constant humidity at a temperature of 100 degrees F. for 336 hours. The panel showed no signs of corrosion.

EXAMPLE 19

A solution of 0.5 grams per liter of 3,4,5 trihydroxybenzoic acid with a PH of about 3.5 was used as an electrolytic cell in which a steel plate was used as the anode and stainless steel was used as the cathode. Sodium sulfate, 0.5 grams, was also added to the solution to increase its conductivity. Twelve volts and a current density of about 11 amps per square foot was applied to the solution for a period of five seconds. The steel plate was then rinsed in D. I. water, dried and then subjected to constant humidity at a temperature of 100 degrees F. for 336 hours. The panel showed no signs of corrosion.

EXAMPLE 20

A solution of 0.5 grams per liter of 2,3,4 trihydroxybenzoic acid and 0.5 gram per liter of resorcylic acid with a PH of about 3.0 was used as an electrolytic cell in which a zinc plate was used as the anode and stainless steel was used as the cathode. Sodium sulfate, 0.5 grams, was also added to the solution to increase its conductivity. Twelve volts and a current density of about 11 amps per square foot was applied to the solution for a period of five seconds. The zinc plate was then rinsed in D. I. water, dried and then coated with a standard polyamide resin, allowed to cure for seven days and subjected to the standard "ASTM 3359-87" dry paint adhesion test. There was no loss of adhesion.

EXAMPLE 21

A solution of 0.5 grams per liter of 2,3,4 trihydroxybenzoic acid and 0.5 gram per liter of 3,4,5 trihydroxybenzoic acid with a PH of about 3.0 was used as an electrolytic cell in which a zinc plated steel panel was used as the anode and stainless steel was used as the cathode. Sodium sulfate, 0.5 grams, was also added to the solution to increase its conductivity. Twelve volts and a current density of about 11 amps per square foot was applied to the solution for a period of five seconds. The zinc plated steel panel was then rinsed in D. I. water, dried and then coated with a standard polyamide resin, allowed to cure for seven days and subjected to the standard "ASTM 3359-87" dry paint adhesion test. There was no loss of adhesion.

EXAMPLE 22

A solution of 0.5 grams per liter of 2,3,4 trihydroxybenzoic acid and 0.5 gram per liter of 3,4,5 trihydroxybenzoic acid with a PH of about 3.0 was used as an electrolytic cell in which a zinc plated steel panel was used as the anode and stainless steel was used as the cathode. Sodium sulfate, 0.5 grams, was also added to the solution to increase its conductivity. Twelve volts and a current density of about 11 amps per square foot was applied to the solution for a period of five seconds. The zinc plated steel panel was then rinsed in D. I. water, dried and exposed to an atmosphere of constant humidity at 70 degrees F. for 24 hours. The panel showed no signs of white corrosion. The panel was then dried, coated with a standard polyamide resin, allowed to cure for seven days and subjected to the standard "ASTM 3359-87" dry paint adhesion test. There was no loss of adhesion.

EXAMPLE 23

A solution of 0.5 grams per liter of 2,3,4 trihydroxybenzoic, 0.5 gram per liter of 3,4,5 trihydroxybenzoic acid and 0.1 grams per liter sodium chloride at a PH of about 3.0 was applied to a zinc plated steel panel at about 120 degrees F. for a period of 30 seconds. The zinc plated steel panel was then rinsed in D. I. water, dried and exposed to an atmosphere of constant humidity at 70 degrees F. for 24 hours. The panel showed no signs of white corrosion. The panel was then dried, coated with a standard polyamide resin, allowed to cure for seven days and subjected to the standard "ASTM 3359-87" dry paint adhesion test. There was no loss of adhesion

EXAMPLE 24

A solution of 0.5 grams per liter of 3,4,5 trihydroxybenzoic acid and 0.1 grams of sodium chloride, at a PH of about 3.5, was applied to a steel plate at about 100 degrees F. for a period of 30 seconds. The steel plate was then rinsed in D. I. water, dried and then subjected to constant humidity at a temperature of 100 degrees F. for 336 hours. The panel showed no signs of corrosion.

EXAMPLE 25

A solution of 0.5 grams per liter of 2,3,4 trihydroxybenzoic acid and 0.1 grams sodium chloride, with a PH of about 3.5, was used to treat a steel plate at about 100 degrees F. for 30 seconds. The steel plate was then rinsed in D. I. water, dried and then coated with a standard polyamide resin, allowed to cure for seven days and subjected to the standard "ASTM 3359-87" dry paint adhesion test. There was no loss of adhesion.

EXAMPLE 26

A solution of 0.5 grams per liter of 2,3,4 trihydroxybenzoic acid, with a PH of about 3.5, was used to treat a steel plate at about 160 degrees F. for 60 seconds. The steel plate was then rinsed in D. I. water, dried and then coated with a standard polyamide resin, allowed to cure for seven days and subjected to the standard "ASTM 3359-87" dry paint adhesion test. There was no loss of adhesion.

EXAMPLE 27

A solution of 0.5 grams per liter of 3,4,5 trihydroxybenzoic acid, with a PH of about 3.5, was used to treat a steel plate at about 160 degrees F. for 60 seconds. The steel plate was then rinsed in D. I. water, dried and then subjected to constant humidity at a temperature of 100 degrees F. for 336 hours. The panel showed no signs of corrosion.

EXAMPLE 28

A solution of 0.5 grams per liter of 2,3,4 trihydroxybenzoic and 0.5 gram per liter of 3,4,5 trihydroxybenzoic acid at a PH of about 3.0 was applied to a zinc plated steel panel at about 160 degrees F. for a period of 30 seconds. The zinc plated steel panel was then rinsed in D. I. water, dried and exposed to an atmosphere of constant humidity at 70 degrees F. for 24 hours. The panel showed no signs of white corrosion. The panel was then dried, coated with a standard polyamide resin, allowed to cure for seven days and subjected to the standard "ASTM 3359-87" dry paint adhesion test. There was no loss of adhesion.

While this invention has been illustrated and described in the preceding disclosure, it is recognized that variations and changes may be made therein without departing from the invention as set forth in the claims.

What is claimed is:

1. A passified tin surfaced article having coated thereon a composition having as its essential ingredients proteins, amino acids, amino acid—protein compounds and amine alcohols wherein composition will allow the article to be painted with an appropriate paint.

2. The passified tin surfaced article of claim 1, wherein the article has a layer of an appropriate paint over the composition to provide a paint protected tin surfaced article that passes the ASTM-D3359 paint adhesion test.

* * * * *